US005239302A

United States Patent [19]

Maeda et al.

[11] Patent Number: 5,239,302

[45] Date of Patent: Aug. 24, 1993

[54] WAVE RECEPTION APPARATUS FOR A MOTOR VEHICLE

[75] Inventors: Masaru Maeda, Kawasaki; Harunori Murakami, Machida; Hiroshi Iijima, Yokohama; Yuji Baba, Machida, all of Japan

[73] Assignee: Nippon Sheet Glass Company, Ltd., Osaka, Japan

[21] Appl. No.: 830,497

[22] Filed: Feb. 4, 1992

Related U.S. Application Data

[63] Continuation of Ser. No. 435,735, Nov. 13, 1989, abandoned.

[30] Foreign Application Priority Data

Nov. 22, 1988 [JP] Japan ..... 63-152025[U]

[51] Int. Cl.[5] ..... H01Q 1/02; H01Q 1/32

[52] U.S. Cl. ..... 343/704; 343/713; 343/860

[58] Field of Search ..... 343/713, 860, 704, 850, 343/852

[56] References Cited

U.S. PATENT DOCUMENTS 4,366,485 12/1982 Hodgkinson ..... 343/850
4,654,669 3/1987 Kropielnicki et al. ..... 343/704

FOREIGN PATENT DOCUMENTS 543021 5/1956 Italy ..... 343/850

*Primary Examiner*—Michael C. Wimer
*Attorney, Agent, or Firm*—Jones, Day, Reavis & Pogue

[57] ABSTRACT

A first inductance element is series-connected into a reception signal path of an antenna circuit between an antenna element and a receiver. A second inductance element is arranged to connect the antenna circuit to ground. These inductance elements series- and parallel-resonate with a ground stray capacitance of the antenna circuit including a feeder cable, so that reduction of gain of the reception system due to the stray capacitance is improved. A damping resistor is coupled to the second inductance element. The system has high reception sensitivity over a wide reception range with eliminating use of a pre-amplifier.

4 Claims, 5 Drawing Sheets

WAVE RECEPTION APPARATUS FOR A MOTOR VEHICLE

This is a continuation of copending application Ser. No. 07/435,735 filed on Nov. 13, 1989, now abandoned.

BACKGROUND OF THE INVENTION

1. Field of the Invention

This invention relates to a wave reception apparatus of a motor vehicle and more particularly, to an apparatus having high sensitivity with using a low gain antenna element.

2. Description of the Prior Art

It is known that defogging heater wires and antenna conductors for receiving FM radio waves are formed on a rear window glass of a motor vehicle and are connected to each other through a stub in order to receive both AM and FM radio waves. This known system is disclosed in U.S. Pat. No. 4,063,247.

The magnitude of an electromotive force $e_0$ for AM radio waves induced within such an antenna depends upon the area of the window glass. Induced e.m.f. $e_0$ becomes smaller as the area of the window glass reduces.

On the contrary, a capacitance of a stray capacity of the antenna to a ground, valued when the antenna is viewed from the input terminal of a tuner, does not reduce in proportion to the area of the window glass, so that if the window glass becomes small, the AM radio waves are not received well in an area where the radio field strength is rather weak. Thus, in a recent broadcast reception system for the vehicle, the induced e.m.f. $e_0$ is supplied to a receiver through a preamplifier.

A well-known antenna pattern shown in FIG. 6 comprises a plurality of defogging heater wires 2 arranged horizontally and divided into two groups, an upper group and, a lower group. The left ends of upper and lower groups of the heater wires 2 are connected to buses 3 and 4, respectively. The right ends of heater wires 2 are connected to a bus 5, so that the upper group and the lower group are power-supplied in series.

A feeding point 6 provided in the bus 5 is connected to a pre-amplifier 9. Input signals induced in the heater wires 2, which are used as an antenna for receiving the AM radio waves, are amplified by the pre-amplifier 9, and then fed to a tuner through a feeder cable 7, such as a coaxial cable.

A heating current to the heater wires 2 flows through choke coils 11*a* and 11*b* which are magnetically coupled with each other, power lines 12 and 13, and the buses 3 and 4. The choke coil 11*a* connected to a power source +B, and the choke coil 11*b* connected to the ground are magnetically coupled negatively to each other, so that a core for the coils 11*a* and 11*b* is not easily saturated. A reception signal induced on the heater wires 2 are not conducted therefrom to the power source or the ground due to high impedance of the choke coils 11*a* and 11*b* in a radio wave band, which improves reception efficiency. A decoupling capacitor 14 is connected to the power source circuit, so that the reception signal is not interfered with noises generated by the power source.

FIG. 7 shows an equivalent circuit of the antenna circuit of FIG. 6, and notations used in FIG. 7 are as follows.

$e_0$: induced electromotive forces of the heater wires 2

$C_1$: an active capacitance of the antenna $C_2$: a reactive capacitance of the antenna $C_L$: a stray capacitance of the power lines 12 and 13

$L_x$: an equivalent inductance of the choke coils 11*a* and 11*b* (equal to one-half of the inductance of each choke coil)

$C_d$: a self-capacitance of the choke coil $C_k$: a stray capacitance of the feeder cable 7

As the vehicle runs, receiving conditions of a radio receiving system mounted on the vehicle vary, that is, the antenna formed on the glass of the rear window is situated in various electric field intensities. Therefore if the amplifier 9 is used to set a high reception gain, the reception signals are apt to be interfered with thermal noises of the amplifier 9, and noises included in the reception signals will be amplified. On the contrary, if radio waves are received near an antenna of a broadcast station, broadcasting voices by radio are distorted due to excessive amplification by the amplifier.

SUMMARY OF THE INVENTION

It is an object of the present invention to provide a broadcast reception apparatus for a motor vehicle in which loss in reception signals is reduced, and high sensitivity is obtained without use of any amplifier.

According to this invention, a reception apparatus for a motor vehicle comprises an antenna circuit including an antenna element for supplying a reception signal to a receiver. A matching circuit is connected into a reception signal path of the antenna circuit. The matching circuit comprises a first inductance element connected in series to the reception signal path so as to series-resonate with a ground stray capacitance of the antenna circuit; a second inductance element connecting the antenna circuit to ground so as to parallel-resonate with the ground stray capacitance of said antenna circuit; and a resistance element connected to said second inductance element so as to compensate for a Q-factor of the parallel resonance.

This reception apparatus needs no pre-amplifier which is disadvantageous on both occasions at too low and too high field intensities.

BRIEF DESCRIPTION OF THE DRAWINGS

These and other objects and features of the invention will be seen by reference to the description, taken in connection with the accompanying drawings, in which.

DESCRIPTION OF THE PREFERRED EMBODIMENT

Figure 1:
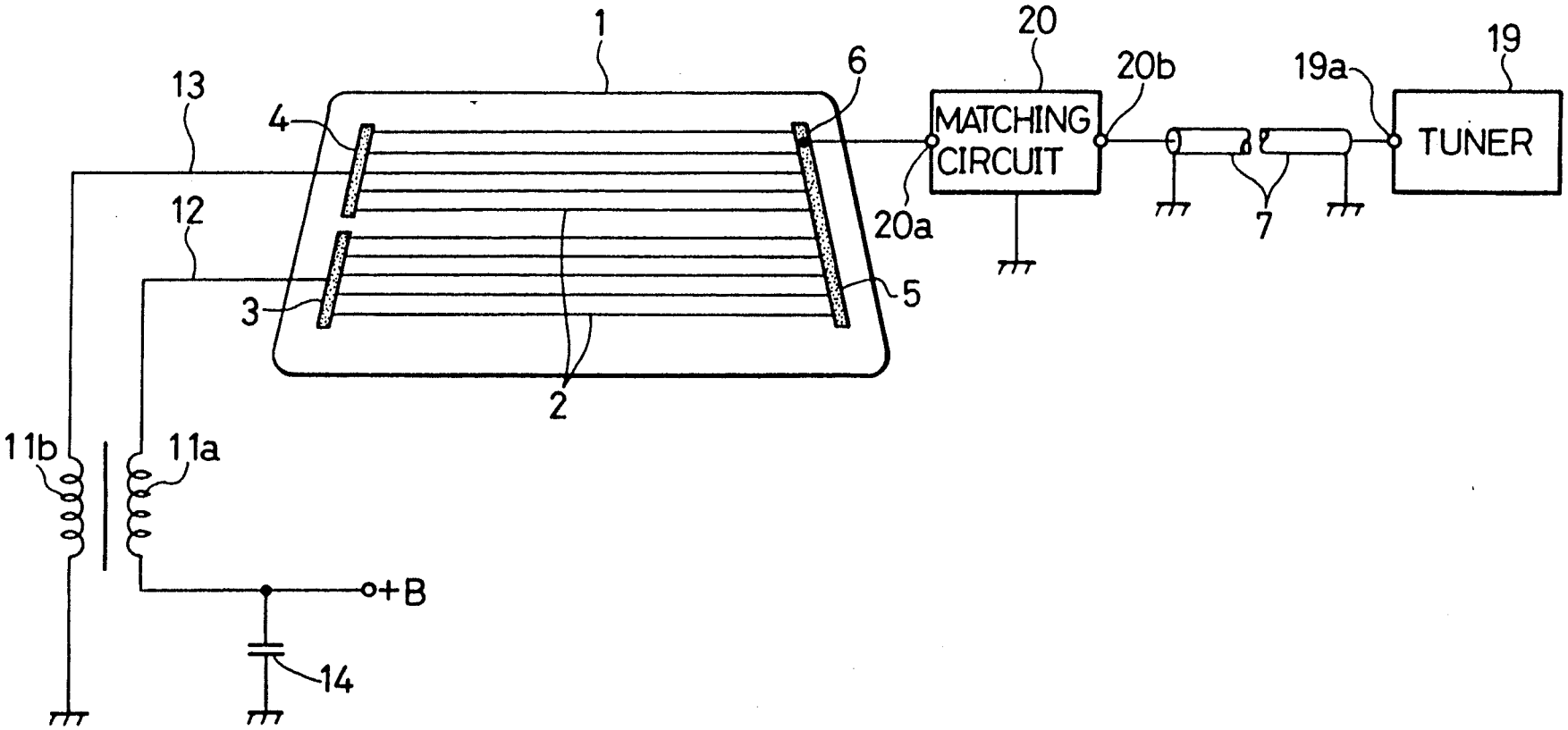
FIG. 1 shows a wiring diagram of an antenna circuit including heater wires formed on a rear window glass of an automobile and used as an antenna, according to an embodiment of the present invention.
Figure 2:
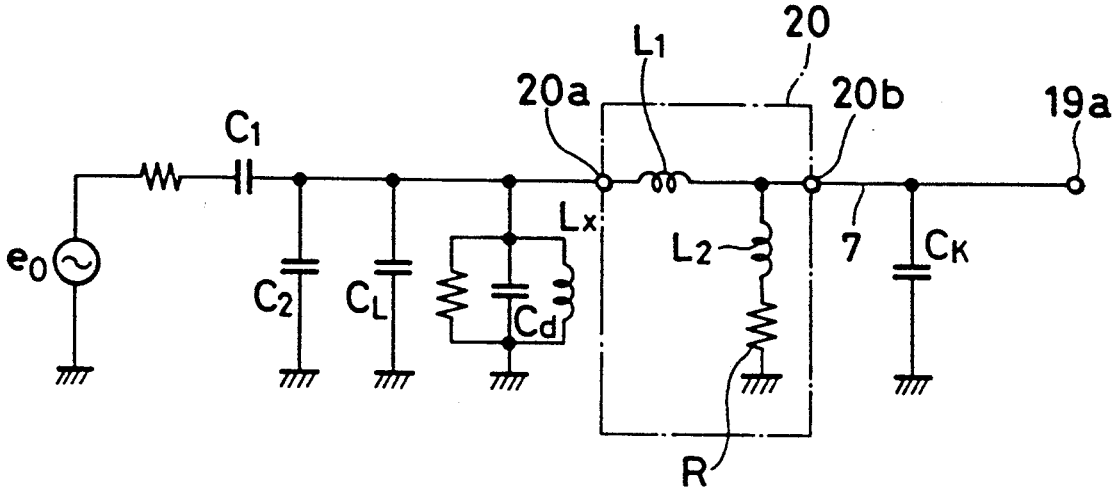
FIG. 2 shows an equivalent circuit of the antenna circuit.

FIG. 1 shows a front view of the rear window glass of an automobile and a wiring diagram of an antenna circuit, where heater wires on the rear window glass are used as an antenna element, according to an embodiment of the present invention. FIG. 2 shows an equivalent circuit of that shown in FIG. 1.

Figure 6:
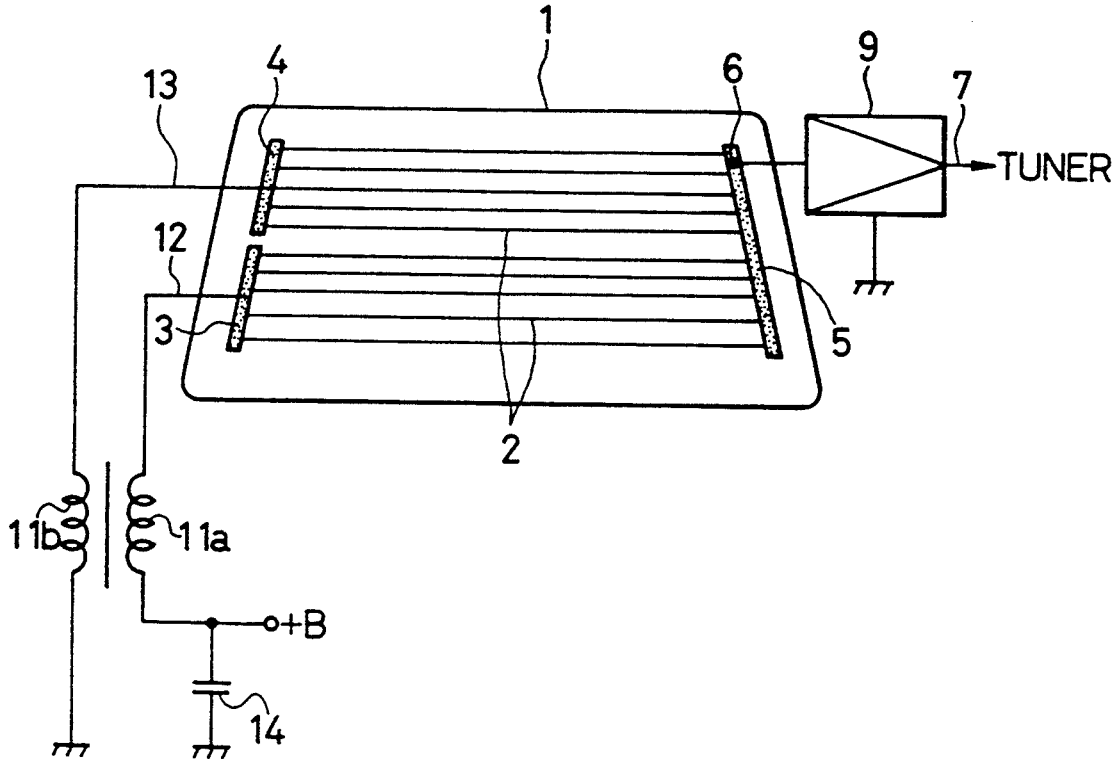
FIG. 6 PRIOR ART
FIG. 6 shows a wiring diagram of a conventional antenna circuit.
Figure 7:
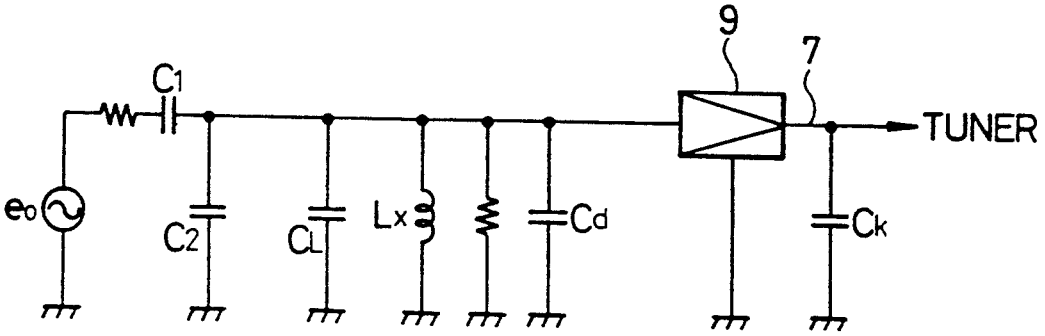
FIG. 7 shows an equivalent circuit of the conventional antenna circuit.

A conductor pattern formed on the windowglass 1 is the same with that shown in FIG. 6 as well as the heating circuit of heater wires 2. In the embodiment, AM radio reception signals induced in the heater wires 2 are derived through a feeding point 6 to a matching circuit 20. The output of the matching circuit 20 is supplied to the input terminal 19*a* of a tuner 19 through a feeder cable 7 having a length of 3 m to 4 m.

Since the pre-amplifier 9 in the prior art is not used, it may offer a problem that a reception sensitivity is low when the electric field intensity is weak. The low sensitivity of the system is caused by a stray capacitance $C_k$ of the feeder cable 7, a stray capacitance $C_L$ of buses 3 and 4, a self-capacitance $C_d$ of choke coils 11*a* and 11*b*, and so forth shown in FIG. 2, serving as reactive capacitances which make reception loss large.

In the embodiment, the matching circuit 20 is provided to improve the sensitivity of the system. As shown in FIG. 2, the matching circuit 20 consists of a first coil $L_1$ connecting the input terminal 20*a* of the matching circuit 20 to the output terminal 20*b* of the matching circuit 2; a second coil $L_2$; and a damping resistor R connected in series with the second coil $L_2$. The series circuit consisting of the second coil $L_2$ and the resistor R is connected between an output end of the first coil $L_1$ and the ground. In other words, the first coil $L_1$ is connected in series with the stray capacitance of the antenna circuit to the ground. The stray capacitance may be totally valued when the antenna circuit is viewed from the tuner 19. The second coil $L_2$ and the damping resistance R are connected in parallel with the stray capacitance.

An inductance of the second coil $L_2$ is fixed so as to parallel-resonate with the reactive capacitance of the antenna circuit in the AM radio band. Thus, the impedance of the antenna to the ground, valued when the antenna is viewed from the input terminal 19*a* of the tuner 19, increases to improve the sensitivity.

If only the coil $L_2$ which has a fixed inductance is connected in parallel with the reactive capacitance so as to parallel-resonate, a Q-factor becomes high, so that a range providing an excessive sensitivity with respect to reception frequencies becomes too narrow. In the embodiment, the damping resistor R is connected in series with the second coil $L_2$ so as to improve the sensitivity over a wide reception bandwidth. The damping resistor R may be connected in parallel with the second coil $L_2$.

Further, the first coil $L_1$ and the reactive capacitances $C_2$, $L_L$, $C_d$, $C_k$ and so forth form an L-type low-path filter. When the inductance of the first coil $L_1$ is fixed so as to cause a sort of series-resonance with the reactive capacitance, the sensitivity is improved for the middle and high range of the reception waves.

In the equivalent circuit shown in FIG. 2, respective values of the inductance of the first coil $L_1$, the inductance of the second coil $L_2$, and the resistance of the damping resistor R were fixed at 150 μH, 620 μH, and 390 ω, for a case where the capacitance $C_1+C_2$ on the window glass is 60 pF; the stray capacitance $C_L$ of a power lines 12 and 13 is 40 pF; the inductance $L_x$ of the choke coils 11*a* and 11*b* is 1.2 mH; the stray capacitance $C_d$ of the choke coils is 19 pF; and the stray capacitance $C_k$ of the feeder cable 7 is 120 pF. A good result was obtained for this example.

Figure 3:
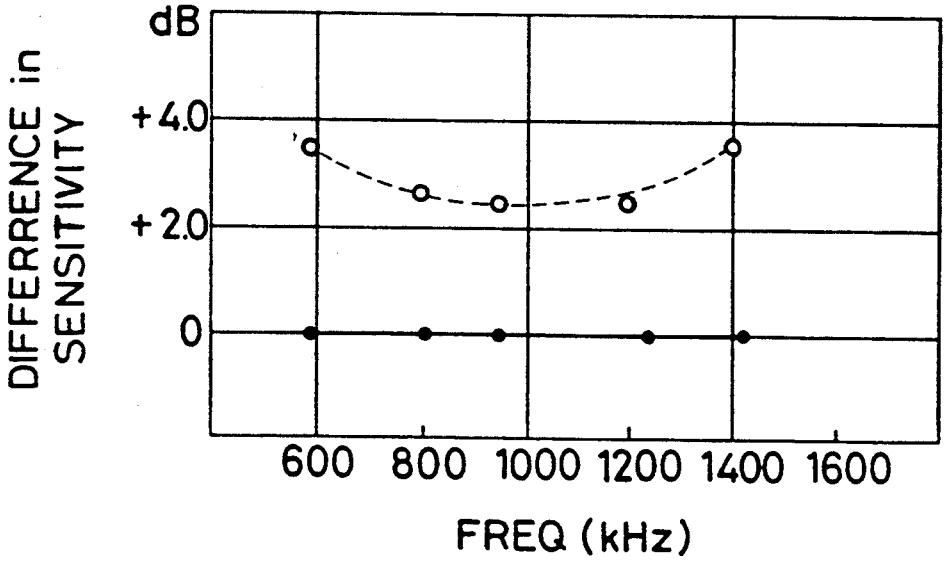
FIG. 3 is a graph showing a sensitivity of the antenna.

FIG. 3 shows a difference sensitivity of AM radio wave reception in a case where the matching circuit 20 is employed, in comparison with a reference case where the matching circuit is not employed. White dots are plotted for the former case and black dots are plotted for the latter case to show a reference (0 dB).

The graph shows that sensitivity rises 2 to 4 dB in the whole range of AM radio wave when the matching circuit is employed. A reception system can be realized to have a sufficient gain without a pre-amplifier even under a weak field intensity. The system produces neither noisy radio voice at a low reception intensity nor distorted radio voice at a high reception intensity. The reception system can be manufactured at a less cost.

In addition, the stray capacitance can be cancelled by the matching circuit 20, so that a cable with high stray capacitance, which is rather economical, may be used in a path from the antenna to the tuner without degrading the sensitivity.

The impedance matching circuit 20 may be arranged at the input of tuner 19. In various arrangements, good results are obtained with values 10 to 300 μH for $L_1$, 200 to 1000 μH for $L_2$ and 100 to 700 ω for R.

In the system shown in FIG. 2, the heater wires 2 are used as an antenna for receiving AM radio waves only. When it is necessary to receive AM and FM radio waves, it is preferable to connect a bypassing capacitor having a capacitance, e.g. 68 pF, in parallel with a first coil $L_1$ for reducing the loss of input signals induced by the FM radio waves. Alternatively, it is preferable to connect a pre-amplifier as mentioned later.

Figure 4:
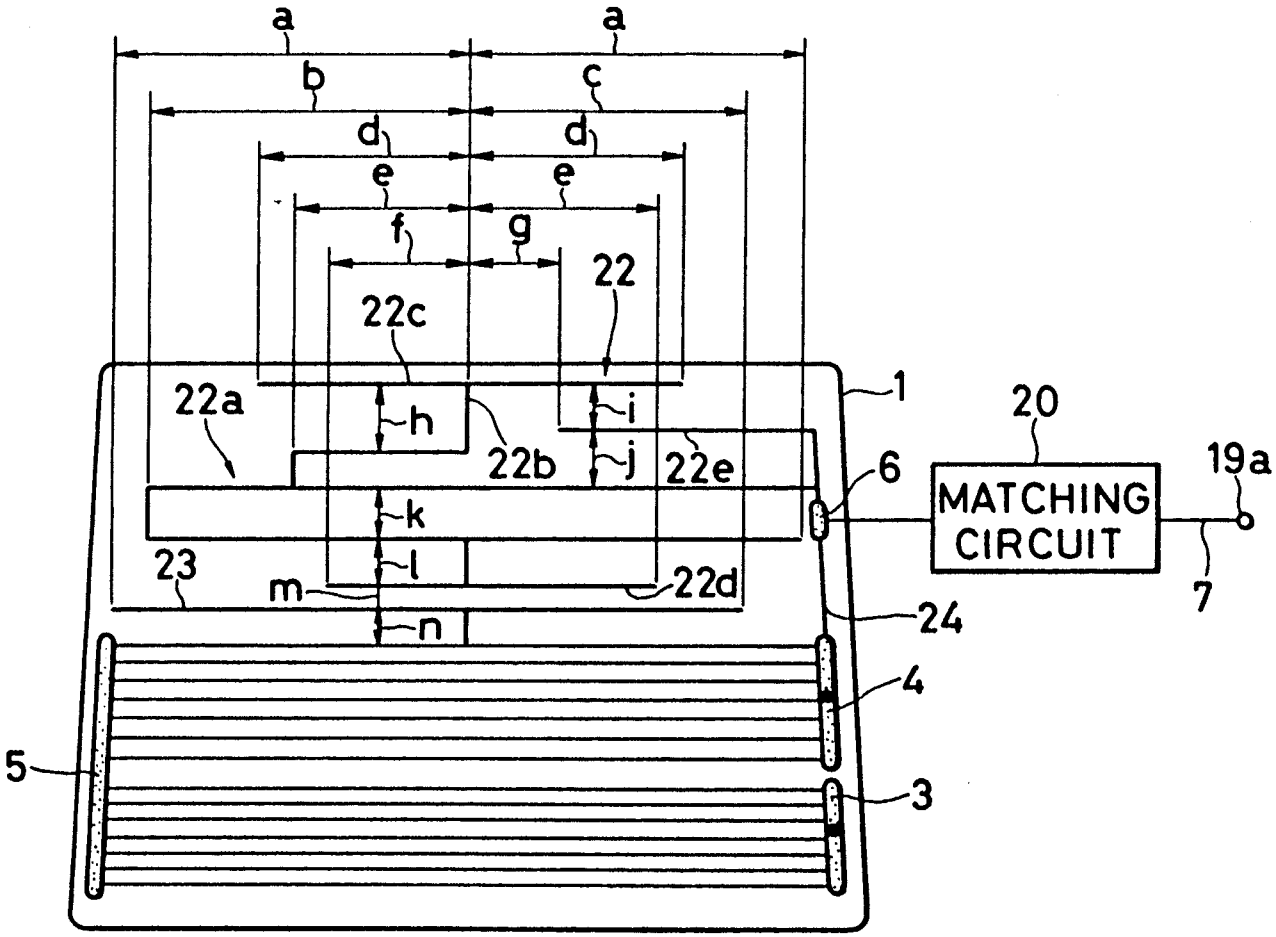
FIG. 4 shows a front view of the rear window glass in which an antenna element is provided together with the heater wires.

An antenna conductor pattern 22 for FM wave reception may additionally be arranged on the window glass 1, as shown in FIG. 4.

The antenna pattern conductor 22 comprises a main antenna 22*a* consisting of two parallel conductors which are connected with each other at respective ends thereof by a conductor having a right angle with the parallel conductors; an auxiliary element 22*c* connected to the upper conductor of the main antenna 22*a* through conductors 22*b*; an auxiliary element 22*d* connected to the lower conductor of the main antenna 22*a* and a folded conductor 22*e* extending from on end of the upper conductor of the main antenna 22*a*. Further, an interactive element 23 connected to the uppermost heater wire 2 is arranged to oppose to the lower element 24*d*. A conductor 24 connects the feeding point 6 to the bus 4 so as to couple the antenna conductor 22 with the heater wires 2.

In FIG. 4, dimensions are given as: a=510 mm; b=475 mm; c=450 mm; d=380 mm; e=300 mm; f=250 mm; g =150 mm; h=20 mm; i=10 mm; j=30 mm; k=35 mm; l=10 mm; m=5 mm; and n=12 mm.

In case of the antenna shown in FIG. 4, the reception signals are induced both in the heater wires 2 and in the antenna pattern 22, so that a good sensitivity is obtained in a wide bandwidth covering AM and FM broadcasts. It is not always necessary to connect the antenna pattern 22 to the heater wires 2 through the conductor 24. When the antenna pattern 22 is not directly connected, the capacitive coupling of the auxiliary element 22*d* with the interactive element 23 may be enhanced so as to deliver a reception signal induced in the heater wires 2 to the antenna pattern 22.

The sensitivity will be further improved, if a type and length of the cable between the antenna and the tuner are pertinently selected to reduce the inherent reactive capacitance of the antenna circuit.

Figure 5:
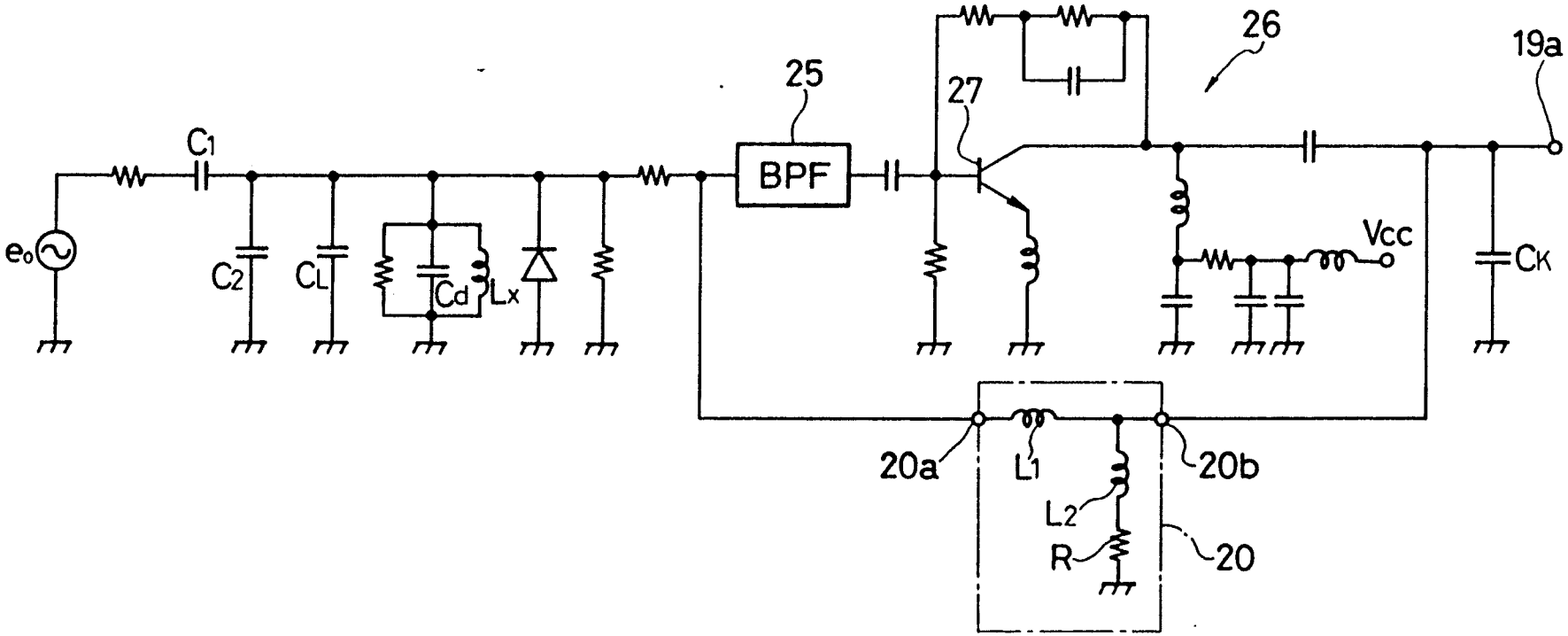
FIG. 5 shows a modification of the antenna circuit for reception of AM and FM radio waves, with FM radio waves amplified by a pre-amplifier.

FIG. 5 shows an equivalent circuit of the antenna for receiving both AM and FM radio waves. In FIG. 5, a pre-amplifier 26 is provided in parallel with the matching circuit 20 to bypass the input and output thereof. The FM reception signals are supplied to the base electrode of a transistor 27 through a band pass filter 25 (BPF), and amplified to be derived to the tuner. According to this circuit, even when there is no area on a window glass to provide an antenna for an exclusive use for receiving FM radio waves, a high sensitivity can be attained in the whole bandwidth of the AM and FM radio waves.

According to this invention, a reception system comprises a coil element $L_2$ connected in parallel with the stray capacitance of the antenna circuit to the ground, valued when the antenna is viewed from the input terminal of a tuner, so as to parallel-resonate with the stray capacitance; a dampling resistor for expanding the bandwidth of the parallel resonance; and a coil element $L_1$ constituting an L-match filter together with the stray capacitance. Impedance of the antenna circuit to ground becomes high over a wide reception range. Thus, the signals induced in the antennas is derived to the tuner with a small loss.

A pre-amplifier needs not be inserted between the antenna, and the tuner. The reception system does not suffer disadvantages from the pre-amplifier which produces noisy reception voices hard to hear at low field intensity and a distorted reception voices at too high field intensity. These disadvantages are removed without reception sensitivity degraded.

What is claimed is:

1. Apparatus for a motor vehicle for receiving both AM and FM radio signals and comprising:

an antenna circuit including an antenna element and a coaxial feeder cable for supplying both the AM and FM radio signals to a receiver, the antenna element being a conductor formed on a surface of a window glass of the motor vehicle, the antenna circuit having a stray capacitance with respect to ground;

an AM frequency matching circuit inserted between the feeder cable and the antenna element;

the Am frequency matching circuit consisting of:

a first inductance element directly connecting the antenna element to the feeder cable so as to be series-resonant with the ground stray capacitance of the antenna circuit including the feeder cable;

a second inductance element connecting a connection point between the first inductance element and the feeder cable to ground so as to form a parallel-resonant circuit with the ground stray capacitance in the AM frequency wave band;

a resistance element connected in series with the second inductance element to increase the antenna element impedance to ground, each value of the first and second inductances and the resistance element being selected to improve the signal sensitivity of the antenna circuit within a wide sensitivity of the antenna circuit within a wide bandwidth of an AM broadcast band; and a bypass circuit for an FM broadcast band connected in parallel with the AM matching circuit, the FM bypass circuit comprising a series coupled band-pass filter and a pre-amplifier, the band-pass filter being connected between the antenna element and the pre-amplifier and the pre-amplifier being connected between the filter and the feeder cable.

2. A wave reception apparatus according to claim 1, wherein said antenna element comprises defogging heater wires formed on a rear window glass of said motor vehicle.

3. A wave reception apparatus according to claim 1, wherein said antenna element comprises an antenna conductor formed on a rear window glass of said motor vehicle and electrically coupled in a radiofrequency band with defogging heater wires formed on the rear window glass.

4. A wave reception apparatus for a motor vehicle comprising:

an antenna circuit including an antenna element and a coaxial feeder cable for supplying an AM signal to a receiver, the antenna element being a conductor formed on a surface of a window glass of the motor vehicle, the antenna circuit having a stray capacitance with respect to ground;

an AM frequency matching circuit inserted between the feeder cable and the antenna element;

the AM frequency matching circuit consisting of:

a first inductance element directly connecting the antenna element to the feeder cable so as to be series-resonant with the ground stray capacitance of the antenna circuit including the feeder cable;

a second inductance element connecting a connection point between the first inductance element and the feeder cable to ground so as to form a parallel-resonant circuit with the ground stray capacitance in the AM frequency wave band; and a resistance element connected in series with the second inductance element to increase the antenna element impedance to ground, each value of the first and second inductances and the resistance element being selected to improve the AM signal sensitivity within a wide bandwidth of the AM broadcast band.

* * * * *